US008590996B2

(12) United States Patent
Kaieda et al.

(10) Patent No.: US 8,590,996 B2
(45) Date of Patent: Nov. 26, 2013

(54) LIQUID EJECTING APPARATUS AND METHOD FOR CONTROLLING LIQUID EJECTING APPARATUS

(71) Applicant: Seiko Epson Corporation, Tokyo (JP)

(72) Inventors: Teruaki Kaieda, Matsumoto (JP); Ryoichi Tanaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/705,962

(22) Filed: Dec. 5, 2012

(65) Prior Publication Data

US 2013/0093811 A1 Apr. 18, 2013

Related U.S. Application Data

(62) Division of application No. 12/892,016, filed on Sep. 28, 2010, now Pat. No. 8,348,367.

(30) Foreign Application Priority Data

Oct. 5, 2009 (JP) ..... 2009-231749

(51) Int. Cl.
*B41J 29/38* (2006.01)
*B41J 2/045* (2006.01)
*B41J 2/17* (2006.01)

(52) U.S. Cl.
USPC ..... 347/11; 347/68; 347/94

(58) Field of Classification Search
None
See application file for complete search history.

(56) References Cited

U.S. PATENT DOCUMENTS

| | | | | |
|---|---|---|---|---|
| 6,312,077 | B1 | 11/2001 | Araki | |
| 6,382,754 | B1 * | 5/2002 | Morikoshi et al. | 347/11 |
| 6,464,315 | B1 | 10/2002 | Otokita et al. | |
| 6,478,395 | B2 * | 11/2002 | Tanaka et al. | 347/11 |
| 6,629,741 | B1 | 10/2003 | Okuda et al. | |
| 7,611,214 | B2 | 11/2009 | Hosono et al. | |
| 2002/0024546 | A1 | 2/2002 | Chang | |

FOREIGN PATENT DOCUMENTS

| | | |
|---|---|---|
| JP | 10-157100 | 6/1998 |
| JP | 2000-158651 | 6/2000 |
| JP | 2001-063042 | 3/2001 |
| JP | 2001-150672 | 6/2001 |
| JP | 2002-113867 | 4/2002 |
| JP | 2006-212590 | 8/2006 |
| JP | 2006-272896 | 10/2006 |

* cited by examiner

*Primary Examiner* — Geoffrey Mruk
(74) *Attorney, Agent, or Firm* — Workman Nydegger

(57) ABSTRACT

A liquid ejecting apparatus includes a liquid ejecting head having a nozzle that ejects liquid and a pressure chamber in communication with the nozzle. A pressure generator causes pressure fluctuation in the liquid retained in the pressure chamber. The liquid ejecting head is capable of ejecting the liquid from the nozzle as a result of operation of the pressure generator. A driving signal generating section generates a driving signal having an ejection pulse for driving the pressure generator to eject the liquid from the nozzle. The ejection pulse is a voltage waveform four waveform portions having, respectively, voltage levels V1, V2, V3 and V4 that satisfy the following conditions (A) and (B).

$$0 \le V3 \le 0.4 \times V2 \quad \text{(A)}$$

$$0.2 \times V2 \le V4 \le V2 \quad \text{(B)}$$

3 Claims, 6 Drawing Sheets

FIG. 5

| | HIGH← | | LEVEL OF IMPORTANCE OF PARAMETER | | | | →LOW | |
|---|---|---|---|---|---|---|---|---|
| PRESENT EXAMPLE | V3/V2 (A) | V4/V2 (B) | T3/Tc (C) | T5/Tc (D) | T7/Tc (E) | T4/Tc (F) | T'/Tc (G) | PRINT RESULT (IMAGE QUALITY) |
| 1 | 0.2 | 0.2 | 0.1 | 0.2 | 0.2 | 0.03 | 0.1 | ◎ |
| 2 | 0.2 | 0.5 | 0.1 | 0.5 | 0.2 | 0.1 | 0.5 | ◎ |
| 3 | 0.2 | 1 | 0.1 | 0.5 | 0.5 | 0.2 | 0.7 | ◎ |
| 4 | 0.4 | 0.2 | 0.1 | 0.2 | 0.2 | 0.03 | 0.1 | ◎ |
| 5 | 0.4 | 0.5 | 0.1 | 0.5 | 0.2 | 0.1 | 0.5 | ◎ |
| 6 | 0.4 | 1 | 0.1 | 0.5 | 0.5 | 0.2 | 0.7 | ◎ |
| 7 | 0.2 | 0.5 | 0.1 | 0.2 | 0.2 | 0.1 | 0.05 | ○ |
| 8 | 0.2 | 0.5 | 0.1 | 0.2 | 0.2 | 0.1 | 0.8 | ○ |
| 9 | 0.2 | 0.5 | 0.1 | 0.2 | 0.2 | 0.02 | 0.5 | ○ |
| 10 | 0.4 | 0.2 | 0.1 | 0.2 | 0.2 | 0.3 | 0.5 | ○ |
| 11 | 0.2 | 0.5 | 0.1 | 0.2 | 0.6 | 0.1 | 0.5 | △ |
| 12 | 0.2 | 0.5 | 0.1 | 0.6 | 0.2 | 0.1 | 0.5 | △ |
| 13 | 0.2 | 0.5 | 0.05 | 0.2 | 0.2 | 0.1 | 0.5 | △ |
| COMPARATIVE EXAMPLE | | | | | | | | |
| 1 | 0.2 | 0.1 | 0.1 | 0.2 | 0.2 | 0.1 | 0.5 | × |
| 2 | 0.2 | 1.1 | 0.1 | 0.2 | 0.2 | 0.1 | 0.5 | × |
| 3 | 0.5 | 0.1 | 0.1 | 0.2 | 0.2 | 0.1 | 0.5 | × |

LIQUID EJECTING APPARATUS AND METHOD FOR CONTROLLING LIQUID EJECTING APPARATUS

This application is a Division of application Ser. No. 12/892,016, filed Sep. 28, 2010, and is expressly incorporated herein by reference. The entire disclosure of Japanese Patent Application No. 2009-231749 filed Oct. 5, 2009 is expressly incorporated by reference herein.

BACKGROUND

1. Technical Field

The present invention generally relates to a liquid ejecting apparatus such as an ink-jet printer and a method for controlling the liquid ejecting apparatus. In particular, the invention relates to a liquid ejecting apparatus that can control the ejection of liquid by applying an ejection pulse to pressure generators and a method for controlling such a liquid ejecting apparatus.

2. Related Art

A liquid ejecting apparatus is an apparatus that can eject various kinds of liquid. The apparatus is provided with a head for liquid ejection. A plurality of nozzles from which the liquid is ejected is formed in the liquid ejecting head. An example of a liquid ejecting apparatus is an image recording apparatus such as an ink-jet printer. An ink-jet printer is provided with an ink-jet recording head, which is an example of various kinds of a liquid ejecting head. An ink-jet printer performs recording by ejecting ink in the form of ink droplets from nozzles of the ink-jet recording head toward a recording target medium such as a sheet of printing paper. As a result of the landing of the discharged ink droplets on the surface of the target object, that is, the recording target medium, dots are formed thereon. In this way, the ink-jet printer records an image and the like on the recording target medium. The ink-jet recording head may be hereinafter simply referred to as a "recording head". The ink-jet printer may be hereinafter simply referred to as a "printer". These days, the application of such a liquid ejecting apparatus is not limited to an image recording apparatus mentioned above; for example, a liquid ejecting apparatus is used as, among many types of manufacturing apparatuses, manufacturing equipment used for production of a color filter for a liquid crystal display device.

For example, the printer has a plurality of nozzle lines each of which is formed as a group of nozzles that are aligned. A pressure chamber is formed in communication with each of the nozzles. An ejection pulse is applied to a means for generating pressure. When the pressure generator is driven, pressure fluctuation occurs in liquid that is retained in the corresponding pressure chamber. The pressure fluctuation is utilized to eject the liquid from the corresponding nozzle, which is in communication with the pressure chamber. Some printers use piezoelectric vibration elements as the pressure generators. Such a printer operates as follows. As a preparatory step, a pressure chamber is expanded first (an expansion step). Then, the pressure chamber is kept in the expanded state for a predetermined length of time (a hold step). Next, the pressure chamber is contracted rapidly (a contraction step). As the pressure chamber contracts, ink that is retained in the pressure chamber is pressurized. By this means, the printer discharges a very small ink droplet of several nanograms (ng) to more than ten nanograms from the nozzle. An example of such a printer of the related art is disclosed in JP-A-2001-63042. According to the printer disclosed in JP-A-2001-63042, parameters such as the waveform of a driving signal used for driving the piezoelectric vibration element, the voltage thereof, and the like are set with due consideration given to the natural frequency of a pressure wave of ink retained in the pressure chamber. Therefore, the disclosed printer is capable of discharging a very small ink droplet without lowering the level of reliability and durability of the piezoelectric actuator.

In the operation of the above type of a printer, when ink is ejected from a nozzle, the tail part of an ink droplet sometimes comes off to form into a satellite droplet, which follows a main droplet. Normally, the velocity of the movement of a satellite droplet in the air is lower than the velocity of the movement of a main droplet in the air. For this reason, the length of time from ejection from a nozzle to landing on a recording target medium for a main droplet is different from that for a satellite droplet. Therefore, when printing is performed while moving a recording head and a recording target medium relative to each other, a position at which a main droplet lands on the recording target medium and a position at which a satellite droplet lands on the recording target medium are shifted from each other. The shift between the landing position of the main droplet and the landing position of the satellite droplet causes degradation in the quality of a print image, which is a problem that remains to be solved.

SUMMARY

An advantage of some aspects of the invention is to provide a liquid ejecting apparatus that can suppress a relative shift between a position at which a main droplet lands on a liquid ejection target medium and a position at which a satellite droplet lands on the liquid ejection target medium and to provide a method for controlling such a liquid ejecting apparatus.

In order to overcome the above disadvantage without any limitation thereto, a liquid ejecting apparatus according to a first aspect of the invention includes: a liquid ejecting head that includes a nozzle from which liquid is ejected, a pressure chamber that is in communication with the nozzle, and a pressure generator that causes pressure fluctuation in the liquid retained in the pressure chamber, the liquid ejecting head being capable of ejecting the liquid from the nozzle as a result of operation of the pressure generator; a driving signal generating section that generates a driving signal that contains an ejection pulse for driving the pressure generator to eject the liquid from the nozzle; and a moving section that moves the liquid ejecting head and a liquid ejection target medium relative to each other, the liquid ejection target medium being a target on which the ejected liquid lands, wherein the liquid ejecting head ejects the liquid from the nozzle when the liquid ejecting head and the liquid ejection target medium are being moved relative to each other so as to cause the liquid to land on the liquid ejection target medium, the ejection pulse is a voltage waveform that includes a first waveform portion in which a voltage level changes in a first direction to cause a change in capacity of the pressure chamber, a second waveform portion in which the voltage level changes in a second direction, which is opposite to the first direction, from an end voltage level of the first waveform portion to cause a change in the capacity of the pressure chamber, a third waveform portion in which the voltage level is kept at an end voltage level of the second waveform portion for a predetermined length of time to keep the capacity of the pressure chamber, or the voltage level changes in the first direction from the end voltage level of the second waveform portion to cause a change in the capacity of the pressure chamber, and a fourth waveform portion in which the voltage level changes in the second direction from an end voltage level of the third waveform portion to cause a change in the capacity of the pressure chamber, and amount of change in the voltage level of the second waveform portion, which is denoted as V2, amount of change in the voltage level of the third waveform portion, which is denoted as V3, and amount of change in the voltage level of the fourth waveform portion, which is denoted as V4, satisfy the following conditions (A) and (B).

$$0 \leq V3 \leq 0.4 \times V2 \quad (A)$$

$$0.2 \times V2 \leq V4 \leq V2 \quad (B)$$

With such a configuration, since the amount of change in the voltage level V2 of the second waveform portion, the amount of change in the voltage level V3 of the third waveform portion, and the amount of change in the voltage level V4 of the fourth waveform portion satisfy the conditions (A) and (B), it is possible to suppress a relative shift between a position at which a main droplet lands on a liquid ejection target medium and a position at which a satellite droplet lands on the liquid ejection target medium. Specifically, when the capacity of the pressure chamber changes as driven by the second waveform portion, the center part of a meniscus becomes protruded toward the liquid ejection target medium. As a result, a liquid column is formed. Then, the capacity of the pressure chamber is kept for a predetermined length of time or is changed in the opposite manner as driven by the third waveform portion. Thereafter, the capacity of the pressure chamber is changed again as driven by the fourth waveform portion. As a result, the meniscus is pushed out toward the liquid ejection target medium. Thus, the tail part of the liquid column is pushed out in an accelerated manner. Therefore, when liquid is ejected from a nozzle, the velocity of the movement of a satellite droplet in the air is higher than the velocity of the movement of a main droplet in the air, which makes it possible to suppress a relative shift between a position at which the main droplet lands on a liquid ejection target medium and a position at which the satellite droplet lands on the liquid ejection target medium.

In the configuration of a liquid ejecting apparatus according to the first aspect of the invention, it is preferable that, when the natural frequency of vibration that occurs in the liquid retained in the pressure chamber is demoted as Tc, the time width of the second waveform portion, which is denoted as Wd1, the time width of the third waveform portion, which is denoted as Wc2, and the time width of the fourth waveform portion, which is denoted as Wd2, should satisfy the following conditions (C), (D), and (E), respectively.

$$0.1 \times Tc \leq Wd1 \quad (C)$$

$$Wc \leq 0.5 \times Tc \quad (D)$$

$$Wd2 \leq 0.5 \times Tc \quad (E)$$

In such a preferred configuration, it is preferable that the ejection pulse should further include an intermediate hold portion between the second waveform portion and the third waveform portion; the voltage level should be kept at the end voltage level of the second waveform portion for a predetermined length of time; and the time width of the intermediate hold portion, which is denoted as Wh2, should satisfy the following condition (F).

$$0.03 \times Tc \leq Wh2 \leq 0.2 \times Tc \quad (F)$$

In such a preferred configuration, it is preferable that time T', which is time from the start of the second waveform portion to the start of the fourth waveform portion, should satisfy the following condition (G).

$$0.1 \times Tc \leq T' \leq 0.7 \times Tc \quad (G)$$

With such a preferred configuration, since the time T' from the start of the second waveform portion to the start of the fourth waveform portion satisfies the condition (G), it is possible to start the operation of the pressure generator by applying the fourth waveform portion to the pressure generator at an optimum point in time with due consideration given to the natural frequency Tc of vibration (i.e., pressure wave) of liquid retained in the pressure chamber that occurs after the change in the capacity of the pressure chamber caused by the application of the second waveform portion thereto. By this means, it is possible to prevent the velocity of a satellite droplet from being higher than necessary or lower, thereby achieving the stable movement of the satellite droplet in the air.

A method for controlling a liquid ejecting apparatus is provided as a second aspect of the invention. The liquid ejecting apparatus includes a liquid ejecting head, a driving signal generating section, and a moving section. The liquid ejecting head includes a nozzle from which liquid is ejected, a pressure chamber that is in communication with the nozzle, and a pressure generator that causes pressure fluctuation in the liquid retained in the pressure chamber. The liquid ejecting head is capable of ejecting the liquid from the nozzle as a result of operation of the pressure generator. The driving signal generating section generates a driving signal that contains an ejection pulse for driving the pressure generator to eject the liquid from the nozzle. The moving section moves the liquid ejecting head and a liquid ejection target medium relative to each other. The liquid ejection target medium is a target on which the ejected liquid lands. The method according to the second aspect of the invention includes: moving the liquid ejecting head and the liquid ejection target medium relative to each other; and ejecting the liquid from the nozzle of the liquid ejecting head while performing the relative movement operation so as to cause the liquid to land on the liquid ejection target medium. The ejection pulse is a voltage waveform that includes a first waveform portion in which a voltage level changes in a first direction to cause a change in capacity of the pressure chamber, a second waveform portion in which the voltage level changes in a second direction, which is opposite to the first direction, from an end voltage level of the first waveform portion to cause a change in the capacity of the pressure chamber, a third waveform portion in which the voltage level is kept at an end voltage level of the second waveform portion for a predetermined length of time to keep the capacity of the pressure chamber, or the voltage level changes in the first direction from the end voltage level of the second waveform portion to cause a change in the capacity of the pressure chamber, and a fourth waveform portion in which the voltage level changes in the second direction from an end voltage level of the third waveform portion to cause a change in the capacity of the pressure chamber. The amount of change in the voltage level of the second waveform portion, which is denoted as V2, the amount of change in the voltage level of the third waveform portion, which is denoted as V3, and the amount of change in the voltage level of the fourth waveform portion, which is denoted as V4, satisfy the following conditions (A) and (B).

$$0 \leq V3 \leq 0.4 \times V2 \quad (A)$$

$$0.2 \times V2 \leq V4 \leq V2 \quad (B)$$

BRIEF DESCRIPTION OF THE DRAWINGS

The invention will be described with reference to the accompanying drawings, wherein like numbers reference like elements.

FIG. 5 is a table that shows experimental results of printing performed by ejecting ink by means of the discharging pulse, where the results represent OK/NG dot shapes on the printing surface of recording paper.

DESCRIPTION OF EXEMPLARY EMBODIMENTS

With reference to the accompanying drawings, an exemplary embodiment of the present invention will now be explained in detail. Although various specific features are explained in the following exemplary embodiment of the invention for the purpose of disclosing preferred modes thereof, the scope of the invention is not limited to the specific embodiment described below unless any intention of restriction is explicitly shown. In the following description, an ink-jet recording apparatus is taken as an example of a liquid ejecting apparatus according to an aspect of the invention. The ink-jet recording apparatus may be hereinafter simply referred to as a "printer".

Figure 1:
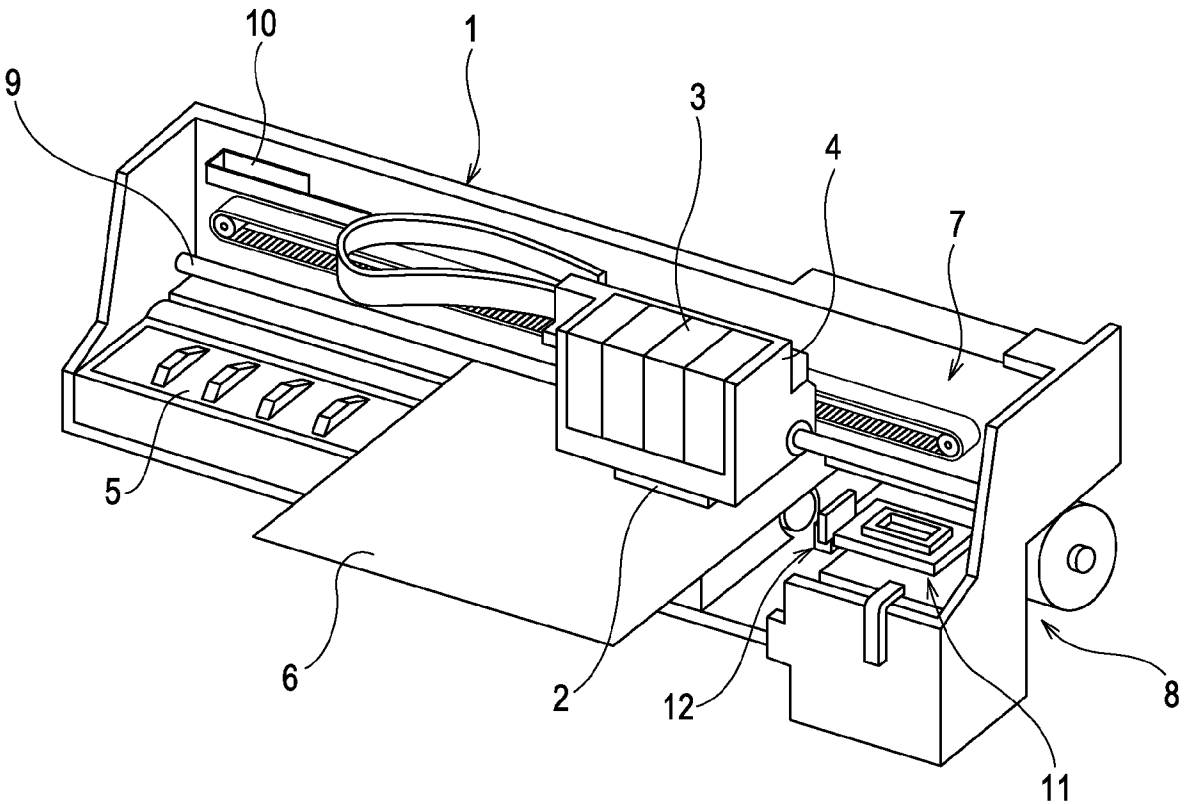
FIG. 1 is a perspective view that schematically illustrates an example of the configuration of a printer according to an exemplary embodiment of the invention.

FIG. 1 is a perspective view that schematically illustrates an example of the configuration of a printer 1. A printer 1 is provided with a carriage 4, a platen 5, a carriage movement mechanism 7, and a paper transport mechanism 8. A recording head 2, which is an example of a liquid ejecting head, is mounted on the carriage 4. A plurality of ink cartridges 3 is detachably attached to the carriage 4. The platen 5 is provided below the recording head 2. The carriage movement mechanism 7 reciprocates the carriage 4 in the direction of the width of a recording target medium such as a sheet of recording paper 6, that is, in the main scan direction. The recording paper 6 is an example of a liquid ejection target medium according to an aspect of the invention. The liquid ejection target medium is a target on which ejected liquid lands. The carriage movement mechanism 7 is an example of a moving section according to an aspect of the invention. The paper transport mechanism 8 transports the recording paper 6 in the sub scan direction, which is orthogonal to the main scan direction.

The carriage 4 is movably supported on a guiding rod 9. The guiding rod 9 extends in the main scan direction. When driven by the carriage movement mechanism 7, the carriage 4 travels in the main scan direction along the guiding rod 9. A linear encoder 10 detects the position of the carriage 4 in the main scan direction. A detection signal is transmitted as an encoder pulse to a control unit 41 of a printer controller 35 (refer to FIG. 3). The control unit 41 can control the recording operation (i.e., ejecting operation) of the recording head 2 while keeping track of the scan position of the carriage 4 (recording head 2) on the basis of the encoder pulse received from the linear encoder 10.

Figure 2:
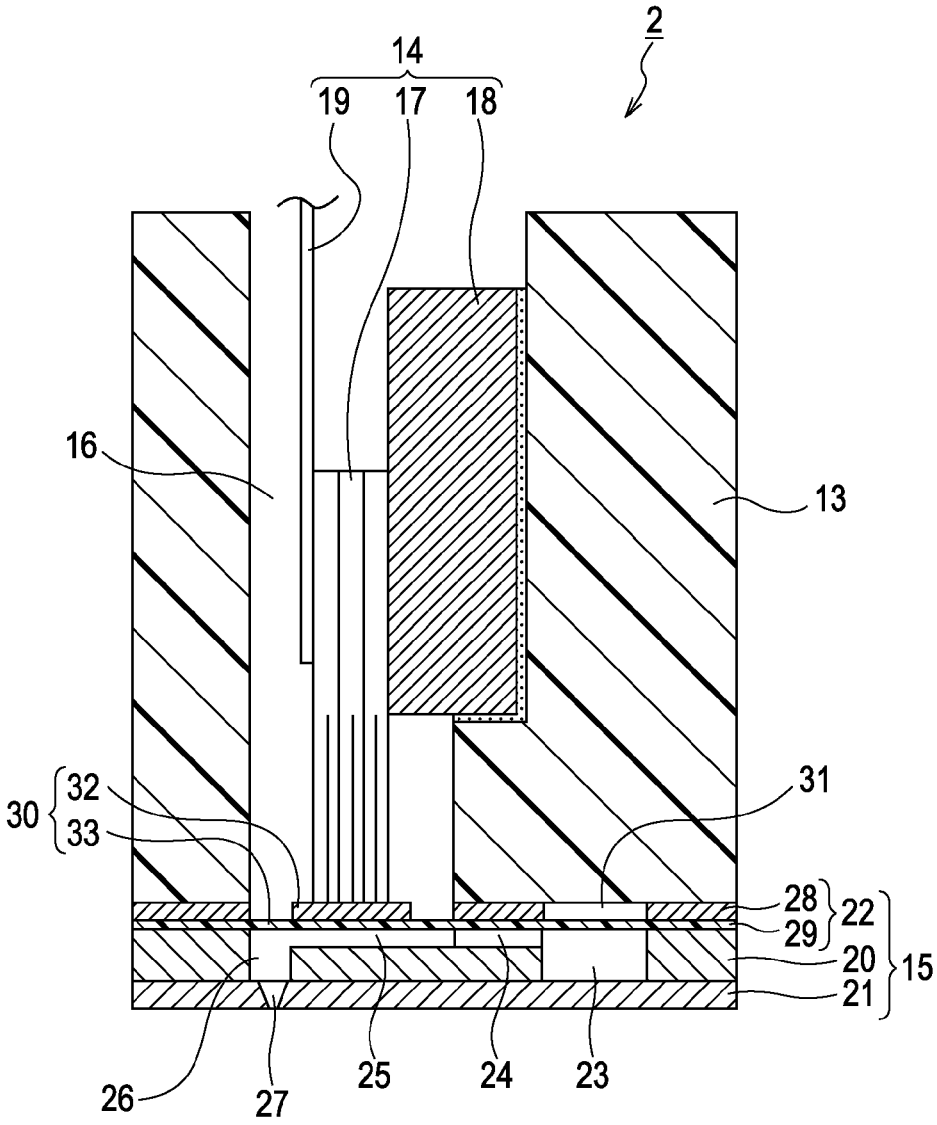
FIG. 2 is a sectional view that schematically illustrates an example of the essential components of a recording head according to an exemplary embodiment of the invention.

A home position is set at an end area that is located outside a recording area but inside the traveling range of the carriage 4. The home position is the base point of scanning operation. In the configuration of the printer 1 according to the present embodiment of the invention, a capping member 11 and a wiping member 12 are provided at the home position. The capping member 11 is used to seal the nozzle surface of the recording head 2. Since a nozzle substrate 21 is provided at the nozzle surface of the recording head 2 as illustrated in FIG. 2, the capping member 11 seals the nozzle substrate 21. The wiping member 12 cleans the nozzle surface of the recording head 2. In outward movement (i.e., outbound movement), the carriage 4 (recording head 2) travels from the home position toward the opposite end. In homeward movement, the carriage 4 travels back to the home position from the opposite end. The printer 1 can record characters, images, and the like on a sheet of the recording paper 6 both during the outward movement and during the homeward movement bidirectionally. That is, the printer 1 performs so-called two-way recording.

FIG. 2 is a sectional view that schematically illustrates an example of the essential components of the recording head 2. The recording head 2 includes a head case 13, a vibrator unit 14, a fluid channel unit 15, and the like. The vibrator unit 14 is encased in the head case 13. The fluid channel unit 15 is fixed to the bottom surface (i.e., the face of the front end) of the head case 13. The head case 13 is made of, for example, epoxy resin. A housing cavity 16 inside which the vibrator unit 14 is mounted is formed inside the head case 13. The vibrator unit 14 includes a plurality of piezoelectric vibration elements 17, a fixation plate 18, and a flexible cable 19. The piezoelectric vibration elements 17 function as pressure generators. The piezoelectric vibration elements 17 are fixed to the fixation plate 18. A driving signal and other signals are supplied to the piezoelectric vibration elements 17 through the flexible cable 19. The piezoelectric vibration elements 17 have a layered structure that is manufactured as follows. Piezoelectric substances and electrodes are laminated alternately to form a piezoelectric plate. The piezoelectric plate having the alternate layers is cut into the form of the teeth of a comb. The piezoelectric vibration elements 17 constitute a so-called longitudinal-vibration-mode piezoelectric vibrator that can stretch and shrink (i.e., expand and contract) in the direction orthogonal to the layer direction.

The fluid channel unit 15 includes a fluid channel substrate 20, the nozzle substrate 21, and an elastic plate 22. The nozzle substrate 21 is bonded to one surface of the fluid channel substrate 20. The elastic plate 22 is bonded to the other surface of the fluid channel substrate 20. A reservoir 23, a plurality of ink supply ports 24, a plurality of pressure chambers 25, a plurality of nozzle ports 26, and a plurality of nozzles 27 are formed inside the fluid channel unit 15 A continuous stretch of a flow passage that extends from the ink supply port 24 to the nozzle 27 through the pressure chamber 25 and the nozzle port 26 is formed for each of the nozzles 27. Ink flows through the flow passage.

The nozzle substrate 21 is a plate member that is made of metal such as stainless. Alternatively, the nozzle substrate 21 may be a silicon single crystal substrate. The plurality of nozzles 27 is formed through the nozzle substrate 21 in lines with a pitch corresponding to dot formation density. For example, the pitch is set at 180 dpi. More than one line of the nozzles 27 is formed through the nozzle substrate 21. For example, each of the plural nozzle lines, that is, each of the plural groups of the nozzles 27, is made up of one hundred eighty nozzles 27. Four ink cartridges 3 each of which contains ink having the corresponding one of four ink colors, which are cyan (C), magenta (M), yellow (Y), and black (K), are detachably attached to the recording head 2 according to the present embodiment of the invention. One nozzle line is formed for each of these four ink colors. Accordingly, the recording head 2 has four nozzle lines.

The elastic plate 22 has a dual layer structure in which an elastic membrane 29 is laminated on the surface of a supporting plate 28. In the present embodiment of the invention, a stainless plate, which is a kind of a metal plate, is used as the supporting plate 28. A resin film is laminated on the surface of the supporting plate 28 to form the elastic membrane 29. The elastic plate 22 is structured as such a laminated composite plate. The elastic plate 22 has a diaphragm portion 30 that can become elastically deformed to change the capacity of the pressure chamber 25. In addition, the elastic plate 22 has a compliance portion 31 that seals a part of the reservoir 23.

The diaphragm portion 30 is formed by partially removing the supporting plate 28. For example, a part of the supporting plate 28 is etched away to form the diaphragm portion 30. The diaphragm portion 30 includes an island portion 32 and a thin elastic portion 33. The surface of the front end of the piezoelectric vibration element 17 is bonded to the island portion 32. The thin elastic portion 33 surrounds the island portion 32. Likewise the diaphragm portion 30, the compliance portion 31 is formed by partially removing the supporting plate 28. Specifically, an area of the supporting plate 28 that faces the opening of the reservoir 23 is etched away to form the compliance portion 31. The compliance portion 31 functions as a damper that absorbs fluctuation in the pressure of liquid retained in the reservoir 23.

Since the surface of the front end of the piezoelectric vibration element 17 is bonded to the island portion 32, it is possible to change the capacity of the pressure chamber 25 as a result of the stretching and shrinking of the piezoelectric vibration element 17. As the capacity of the pressure chamber 25 changes, pressure fluctuation occurs in ink that is retained in the pressure chamber 25. The recording head 2 discharges ink droplets from the nozzles 27 by utilizing the above pressure fluctuation.

Figure 3:
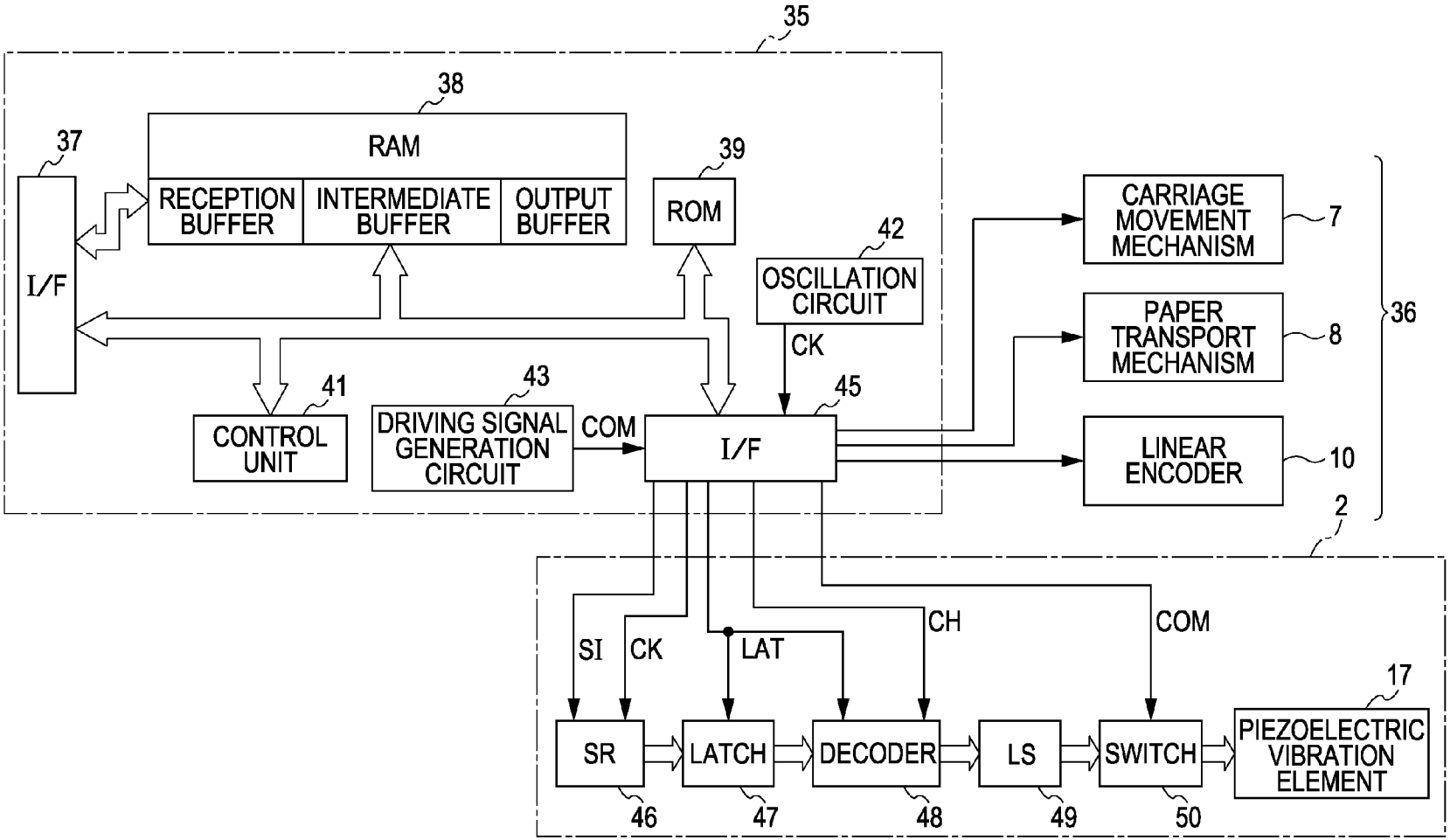
FIG. 3 is a block diagram that schematically illustrates an example of the electric configuration of a printer according to an exemplary embodiment of the invention.

FIG. 3 is a block diagram that schematically illustrates an example of the electric configuration of the printer 1. The printer 1 includes the printer controller 35 and a print engine 36 as its main components. The printer controller 35 includes an external interface (hereafter abbreviated as "I/F") 37, a RAM 38, a ROM 39, a control unit 41, an oscillation circuit 42, a driving signal generation circuit 43, and an internal I/F 45. Print data and other data are inputted into the external I/F 37 from an external device such as a host computer or the like. The RAM 38 stores various kinds of data and the like. The ROM 59 stores control routines used for processing various kinds of data. The oscillation circuit 42 generates a clock signal. The driving signal generation circuit 43 generates a driving signal that is supplied to the recording head 2. The driving signal generation circuit 43 is an example of a driving signal generating section according to an aspect of the invention. The internal I/F 45 outputs pixel data, which is obtained by expanding the print data on a dot-by-dot basis, a driving signal, and the like to the recording head 2.

The control unit 41 outputs a head control signal to the recording head 2 for controlling the operation thereof. The control unit 41 outputs, to the driving signal generation circuit 43, a signal generation control signal that commands the driving signal generation circuit 43 to generate a driving signal COM. The head control signal includes, for example, a transfer clock CLK, pixel data SI, a latch signal LAT, and a change signal CH. The latch signal and the change signal specify the pulse timing of the driving signal COM.

On the basis of the print data, the control unit 41 performs color conversion processing, halftone processing, dot pattern expansion processing, and the like. Specifically, in the color conversion processing, colors in an RGB color coordinate system (i.e., colorimetric system) are converted into colors in a CMYK color coordinate system. In the halftone processing, data of multiple tones is converted into data of predetermined tones for tone reduction. In the dot pattern expansion processing, the halftone-processed data is arrayed in a predetermined layout pattern for expansion into dot pattern data for each type of ink. In other words, the halftone-processed data is arrayed in a predetermined layout pattern for each nozzle line. Through the color conversion processing, the halftone processing, and the dot pattern expansion processing, the control unit 41 generates the pixel data SI that is used for controlling the ejecting operation of the recording head 2. The pixel data SI is data containing information on the pixels of an image that is to be printed. The pixel data SI is a kind of ejection control information. Herein, the term "pixel" means a dot formation area that is virtually determined on a recording target medium such as a sheet of printing paper on the surface of which ejected ink lands. The pixel data SI according to the present embodiment of the invention contains tone information on the presence/absence of dots that are to be formed on a recording target medium (or the ejection or non-ejection of ink) and the size of a dot (or the amount of ink ejected). The pixel data SI according to the present embodiment of the invention is binary data containing a 2-bit tone value.

Next, the configuration of the print engine 36 is explained below. The print engine 36 includes the recording head 2, the carriage movement mechanism 7, the paper transport mechanism 8, and the linear encoder 10. The recording head 2 is provided with a shift register (shown as SR in the drawing) 46, a latch 47, a decoder 48, a level shifter (LS) 49, a switch 50, and the piezoelectric vibration element 17 for each of the plurality of nozzles 27. In synchronization with a clock signal (CK) outputted from the oscillation circuit 42, the pixel data (SI) is transferred serially from the printer controller 35 to the shift registers 46.

The latch 47 is electrically connected to the shift register 46. When the latch signal (LAT) outputted from the printer controller 35 is inputted into the latch 47, the latch 47 latches the pixel data that has been transferred to the shift register 46. The pixel data latched by the latch 47 is inputted into the decoder 48. The decoder 48 translates the 2-bit pixel data to generate pulse selection data. Accordingly, the pulse selection data according to the present embodiment of the invention is 2-bit data.

Triggered by the reception of either the latch signal (LAT) or the channel signal (CH), the decoder 48 outputs the pulse selection data to the level shifter 49. The pulse selection data are inputted into the level shifter 49 sequentially in a descending bit order. The level shifter 49 functions as a voltage amplifier. When the pulse selection data is [1], the level shifter 49 outputs an electric signal that has a boosted voltage level that is high enough to drive the switch 50. For example, a boosted electric signal of tens of volts or so is outputted. The voltage boosted at the level shifter 49 when the pulse selection data is [1] is applied to the switch 50. The driving signal COM outputted from the driving signal generation circuit 43 is supplied to the input terminal of the switch 50. The output terminal of the switch 50 is connected to the piezoelectric vibration element 17.

The pulse selection data is used to control the operation of the switch 50. That is, it is used to control the supplying of a discharging pulse contained in a driving signal to the piezoelectric vibration element 17. For example, the switch 50 is set in a connected state during a time period in which the pulse selection data inputted into switch 50 is [1]. In this state, a discharging pulse is supplied to the piezoelectric vibration element 17. The level of a voltage changes at the piezoelectric vibration element 17 in accordance with the waveform of the discharging pulse. No electric signal for activating the switch 50 is outputted from the level shifter 49 during a time period in which the pulse selection data is [0]. Therefore, the switch 50 is set in a disconnected state. Accordingly, no discharging pulse is supplied to the piezoelectric vibration element 17.

Figure 4:
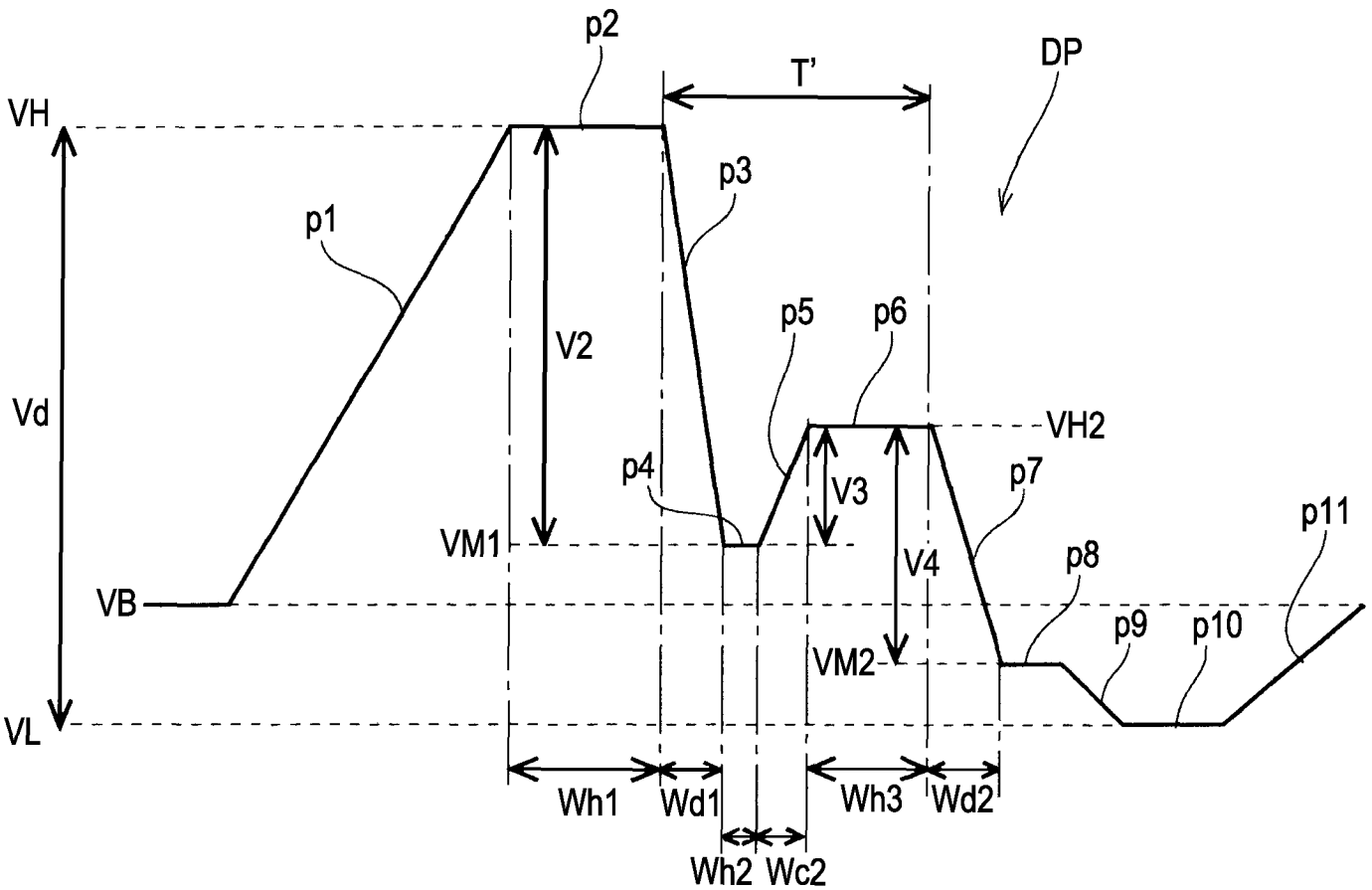
FIG. 4 is a diagram that schematically illustrates an example of the waveform of a discharging pulse according to an exemplary embodiment of the invention.

FIG. 4 is a diagram that schematically illustrates an example of the waveform of a discharging pulse DP contained in the driving signal COM, which is generated by the driving signal generation circuit 43. As illustrated in FIG. 4, the discharging pulse DP is made up of a plurality of waveform portions, which are: a preparatory expansion portion p1, an expansion hold portion p2, a contraction portion p3, a contraction hold portion p4, a re-expansion portion p5, a re-expansion hold portion p6, a re-contraction portion p7, a re-contraction hold portion p8, a vibration suppression contraction portion p9, a vibration suppression hold portion p10, and a return expansion portion p11. The preparatory expansion portion p1 corresponds to a first waveform portion. The contraction portion p3 corresponds to a second waveform portion. The contraction hold portion p4 corresponds to an intermediate hold portion. The re-expansion portion p5 corresponds to a third waveform portion. The re-contraction portion p7 corresponds to a fourth waveform portion. The preparatory expansion portion p1 is a pulse portion in which the level of a voltage changes in the positive direction (which corresponds to a first direction) (i.e., rises) at a constant inclination from a base voltage level VB to an expansion voltage level VH. The expansion hold portion p2 is a pulse portion in which the level of a voltage is kept at the expansion voltage level VH, which is the end voltage level of the preparatory expansion portion p1. The contraction portion p3 is a pulse portion in which the level of a voltage changes in the negative direction (which corresponds to a second direction) (i.e., falls) from the expansion voltage level VH to a first medium voltage level VM1 during time Wd1. The contraction hold portion p4 is a pulse portion in which the level of a voltage is kept at the first medium voltage level VM1. The re-expansion portion p5 is a pulse portion in which the level of a voltage changes in the positive direction from the first medium voltage level VM1 to a re-expansion voltage level VH2 during time Wc2. The re-expansion hold portion p6 is a pulse portion in which the level of a voltage is kept at the re-expansion voltage level VH2. The re-contraction portion p7 is a pulse portion in which the level of a voltage changes in the negative direction from the re-expansion voltage level VH2 to a second medium voltage level VM2 during time Wd2. The re-contraction hold portion p8 is a pulse portion in which the level of a voltage is kept at the second medium voltage level VM2. The vibration suppression contraction portion p9 is a pulse portion in which the level of a voltage changes in the negative direction from the second medium voltage level VM2 to a contraction voltage level VL. The vibration suppression hold portion p10 is a pulse portion in which the level of a voltage is kept at the contraction voltage level VL. Finally, the return expansion portion p11 is a pulse portion in which the level of a voltage returns at a constant inclination from the contraction voltage level VL to the base voltage level VB.

The parameters of the discharging pulse DP, which is made up of the above waveform portions, are set at values that can suppress a relative shift between a position at which a main droplet lands on a recording target medium and a position at which a satellite droplet lands on the recording target medium when the discharging pulse DP is applied as a driving pulse to each of the piezoelectric vibration elements 17 to eject ink from the corresponding nozzle 27. The parameter characteristics of the discharging pulse DP are explained in detail below.

The amount of change in electrical potential (i.e., voltage level) V2 of the contraction portion p3 of the discharging pulse DP (i.e., the absolute value of a potential difference between the expansion voltage level VH, which is the start voltage level of the contraction portion p3, and the first medium voltage level VM1, which is the end voltage level thereof), the amount of change in electrical potential V3 of the re-expansion portion p5 thereof (i.e., the absolute value of a potential difference between the first medium voltage level VM1, which is the start voltage level of the re-expansion portion p5, and the re-expansion voltage level VH2, which is the end voltage level thereof), and the amount of change in electrical potential V4 of the re-contraction portion p7 thereof (i.e., the absolute value of a potential difference between the re-expansion voltage level VH2, which is the start voltage level of the re-contraction portion p7, and the second medium voltage level VM2, which is the end voltage level thereof) are set at values that satisfy the following mathematical conditions (A) and (B).

$$0 \leq V3 \leq 0.4 \times V2 \quad \text{(A)}$$

$$0.2 \times V2 \leq V4 \leq V2 \quad \text{(B)}$$

As shown in the above formula (A), the amount of change in electrical potential V3 of the re-expansion portion p5 is set at a value that is not smaller than zero and not larger than 40% of the amount of change in electrical potential V2 of the contraction portion p3. The amount of change in electrical potential V3 is a parameter that is mainly relevant to the size of an ink column (liquid column) after the formation of the ink column on meniscus by the contraction portion p3, the degree of easiness in releasing from the meniscus, and the velocity of the movement of an ejected main droplet in the air, which will be explained later. In a case where the amount of change in electrical potential V3 is zero, a combination of the contraction hold portion p4, the re-expansion portion p5, and the re-expansion hold portion p6 functions as a contraction hold portion. In this case, the level of a voltage is kept at the first medium voltage level VM1 for a predetermined length of time until the pressure chamber 25 contracts again when the re-contraction portion p7 is applied to the piezoelectric vibration element 17. As shown in the above formula (B), the amount of change in electrical potential V4 of the re-contraction portion p7 is set at a value that is not smaller than 20% of the amount of change in electrical potential V2 and not larger than the amount of change in electrical potential V2. The amount of change in electrical potential V4 is a parameter that is mainly relevant to the amount of pushing the tail part of an ink column. The tail part is a part that will form into a satellite droplet when released.

When the Helmholtz frequency of vibration (i.e., natural vibration frequency) that occurs in ink retained in the pressure chamber 25 (i.e., pressure wave) is demoted as Tc, the time width (i.e., the length of time from the start to the end) Wd1 of the contraction portion p3, the time width Wc2 of the re-expansion portion p5, and the time width Wd2 of the re-contraction portion p7 are set at values that satisfy the following mathematical conditions (C), (D), and (E), respectively.

$$0.1 \times Tc \leq Wd1 \quad \text{(C)}$$

$$Wc2 \leq 0.5 \times Tc \quad \text{(D)}$$

$$Wd2 \leq 0.5 \times Tc \quad \text{(E)}$$

In addition, the time width Wh2 of the contraction hold portion p4 is set at a value that satisfies the following mathematical condition (F).

$$0.03\times Tc\leq Wh2\leq 0.2\times Tc \quad (F)$$

In the above formulae, the value Tc is inherently determined on the basis of the shape, dimension, rigidity, and other factors of constituent elements including the nozzle 27, the pressure chamber 25, the ink supply port 24, the piezoelectric vibration element 17, and the like. The natural vibration frequency Tc can be mathematically expressed by, for example, the following formula (1).

$$Tc=\sqrt{[\{(Mn\times Ms)/(Mn+Ms)\}\times Cc]} \quad (1)$$

In the above formula (1), Mn denotes the inertance of the nozzle 27. The inertance of the ink supply port 24 is denoted as Ms in the above formula (1). The compliance of the pressure chamber 25, which indicates a change in capacity per unit pressure and the degree of softness, is denoted as Cc therein. In addition, in the above formula (1), the inertance M indicates the degree of easiness in the movement of liquid through a flow passage including the nozzle 27. In other words, the inertance M indicates the mass of liquid per unit section area. Let the density of liquid be denoted as ρ. Let a cross section taken along a plane orthogonal to the direction of the flow of liquid through the flow passage be denoted as S. Let the length of the flow passage be denoted as L. Then, the inertance M can be approximately expressed by the following formula (2).

$$M=(\rho\times L)/S \quad (2)$$

Note that Tc is not limited to the value shown in the above formula (1). It may be other vibration frequency of the pressure chamber 25 of the recording head 2.

Moreover, time T' from the start of the contraction portion p3 to the start of the re-contraction portion p7 is set at a value that satisfies the following mathematical condition (G).

$$0.1\times Tc\leq T'\leq 0.7\times Tc \quad (G)$$

That is, T' denotes the length of time from a point in time at which the pressure chamber 25 starts to contract upon the start of the contraction portion p3 to a point in time at which the pressure chamber 25 starts to contract again upon the start of the re-contraction portion p7. Since the time T' is set at a value that satisfies the above formula (G), it is possible to start the re-contraction of the pressure chamber 25 by applying the re-contraction portion p7 to the piezoelectric vibration element 17 at an optimum point in time on the basis of the natural frequency Tc of vibration of ink retained in the pressure chamber 25 that occurs due to contraction of the pressure chamber 25 caused by the application of the contraction portion p3 thereto.

Figure 6A:
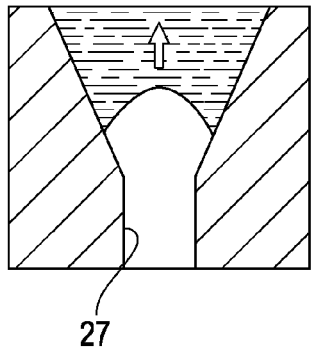
FIGS. 6A to 6D are a set of sectional views that schematically illustrates an example of the ejection of ink from a nozzle.

When the discharging pulse DP having the above pulse pattern is applied to the piezoelectric vibration element 17, as a first step, the piezoelectric vibration element 17 becomes deformed in a shrinking manner in the direction of the length thereof because of the application of the preparatory expansion portion p1 thereto. Since the piezoelectric vibration element 17 shrinks, the capacity of the pressure chamber 25 increases from base capacity, which corresponds to the base voltage level VB, to expansion capacity, which corresponds to the expansion voltage level VH (a first change step). That is, the pressure chamber 25 expands when the preparatory expansion portion p1 is applied to the piezoelectric vibration element 17. Since the pressure chamber 25 expands, as illustrated in FIG. 6A, the surface of ink (i.e., meniscus) at the nozzle 27 is vigorously sucked toward the pressure chamber 25 (upward in the drawing). In addition, since the pressure chamber 25 expands, ink flows from the reservoir 23 into the pressure chamber 25 through the ink supply port 24. The pressure chamber 25 is kept in an expanded state for the period of time Wh1 due to the application of the expansion hold portion p2 to the piezoelectric vibration element 17 (a hold step).

Figure 6B:
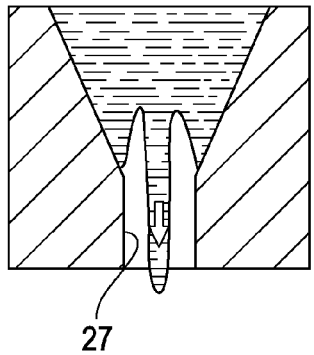
Figure 6C:
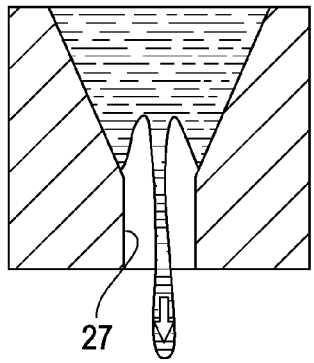

Subsequent to the expansion hold portion p2, the contraction portion p3 is applied to the piezoelectric vibration element 17. As a result, the piezoelectric vibration element 17 becomes deformed in a stretching manner in the direction of the length thereof. Since the piezoelectric vibration element 17 stretches, the capacity of the pressure chamber 25 decreases from the expansion capacity to intermediate contraction capacity, which corresponds to the first medium voltage level VM1, during the time Wd1 (a second change step). That is, the pressure chamber 25 contracts when the contraction portion p3 is applied to the piezoelectric vibration element 17. Since the pressure chamber 25 contracts, ink retained in the pressure chamber 25 is pressurized. Because of the pressure, as illustrated in FIG. 6B, the center part of the meniscus is pushed out toward an ejection target medium (downward in the drawing). The pushed-out part of the meniscus extends to form an ink column (liquid column). Next, the contraction hold portion p4 is applied to the piezoelectric vibration element 17. The capacity of the pressure chamber 25 is kept at the intermediate contraction capacity during the time Wh2 (an intermediate hold step). The deformation of the piezoelectric vibration element 17 is stopped in the intermediate hold step. Meanwhile, the ink column formed at the center part of the meniscus stretches in the direction of ejection due to an inertial force. Next, when the re-expansion portion p5 is applied to the piezoelectric vibration element 17, the piezoelectric vibration element 17 shrinks by a comparatively small amount. Therefore, the capacity of the pressure chamber 25 increases from the intermediate contraction capacity to re-expansion capacity, which corresponds to the re-expansion voltage level VH2, during the time Wc2 (a third change step). Since the pressure chamber 25 re-expands, the meniscus is sucked toward the pressure chamber 25. In a state in which the ink column formed at the center part of the meniscus is stretching in the direction of ejection due to the inertial force, the meniscus is sucked in the direction that is opposite to the stretching direction as illustrated in FIG. 6C. Therefore, at this moment, the ink column is in a state in which it can become released from the meniscus easily. In addition, the velocity of the movement of the head part of the ink column, which will form into a main droplet when released, is reduced. The re-expansion hold portion p6 keeps the capacity of the pressure chamber 25 at the re-expansion capacity during the time Wh3 (a re-expansion hold step).

Figure 6D:
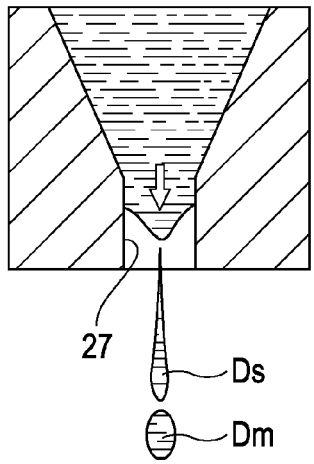

Subsequent to the re-expansion hold portion p6, the re-contraction portion p7 is applied to the piezoelectric vibration element 17 at the timing of displacement in the vibration frequency Tc of the meniscus from the pressure-chamber side to the ejection-target-medium side. As a result, the piezoelectric vibration element 17 becomes deformed in a stretching manner in the direction of the length thereof. Since the piezoelectric vibration element 17 stretches, the capacity of the pressure chamber 25 decreases from the re-expansion capacity to re-contraction capacity, which corresponds to the second medium voltage level VM2 (a fourth change step). Therefore, as illustrated in FIG. 6D, the entire meniscus is pushed rapidly in the direction of ejection. Thus, the movement of the tail part of the ink column is accelerated. The ink column is finally released from the meniscus. The released part will form into an ink droplet, which is ejected from the nozzle 27 and moves in the air. The ejected ink droplet is made up of two droplet portions, which are a main droplet Dm and a satellite droplet Ds. The satellite droplet Ds follows the main droplet Dm.

In the present embodiment of the invention, ink retained in the pressure chamber 25 is pressurized due to the application of the contraction portion p3 to the piezoelectric vibration element 17. Because of the pressure, the center part of a meniscus is pushed out toward an ejection target medium. Next, the contraction hold portion p4 is applied thereto to hold the pressurized state of the ink retained in the pressure chamber 25 (intermediate holding). Then, the re-expansion portion p5 is applied thereto to re-expand the pressure chamber 25. Therefore, the movement of the head part of the ink column, which will form into the main droplet Dm when released, is decelerated. Subsequent to the re-expansion hold portion p6, the re-contraction portion p7 is applied thereto to re-contract the pressure chamber 25. As a result, the movement of the tail part of the ink column, which will form into the satellite droplet Ds when released, is accelerated. Therefore, the velocity of the movement of the satellite droplet Ds in the air is higher than the velocity of the movement of the main droplet Dm in the air. For this reason, the satellite droplet Ds approaches the main droplet Dm in the air during a period of time from ejection from the nozzle 27 to landing on the recording surface of a recording target medium. Consequently, the shape of a dot that is formed on the recording surface of the recording target medium as a result of the landing of the main droplet Dm and the satellite droplet Ds thereon is close to a circle or an ellipse.

After the re-contraction of the pressure chamber 25 due to the application of the re-contraction portion p7 to the piezoelectric vibration element 17, the re-contraction hold portion p8 is applied thereto to keep the capacity of the pressure chamber 25 at the re-contraction capacity for a predetermined length of time (a re-contraction hold step). Thereafter, the vibration suppression contraction portion p9 is applied to the piezoelectric vibration element 17 to decrease the capacity of the pressure chamber 25 from the re-contraction capacity to the minimum capacity, which corresponds to the contraction voltage level VL. Then, the vibration suppression hold portion p10 is applied thereto to keep the capacity of the pressure chamber 25 at the minimum capacity for a predetermined length of time. Thereafter, the return expansion portion p11 is applied thereto. As a result, the capacity of the pressure chamber 25 returns slowly from the minimum capacity to the base capacity, which is the stationary capacity of the pressure chamber 25. The vibration suppression contraction portion p9, the vibration suppression hold portion p10, and the return expansion portion p11 suppress the residual vibration of a meniscus.

FIG. 5 is a table that shows experimental results of printing performed by ejecting ink by means of the discharging pulse DP. Examples 1 to 13 of the present embodiment show thirteen results of the experiment conducted while changing values in the mathematical conditions (A) to (F) shown above. Comparative examples 1, 2, and 3 show results obtained when the indispensable conditions (A) and (B) of the invention are not satisfied. Each of the print results shows evaluated quality in the shape of a dot that is formed on a recording target medium (e.g., recording paper 6) as a result of the landing of the main droplet Dm and the satellite droplet Ds thereon. Specifically, each double-circle symbol denotes a state in which a single perfect dot is formed on the recording target medium as a result of the landing of the main droplet Dm and the satellite droplet Ds thereon at substantially the same position. That is, the double-circle symbol denotes an ideal dot formation result. Each single-circle symbol denotes a state in which the shape of a dot formed on the recording target medium is an ellipse or resembles a "snowman" because the position at which the main droplet Dm has landed and the position at which the satellite droplet Ds has landed are shifted from each other in the direction of the relative movement of the recording head 2 and the recording target medium. Though the state shown by the single-circle symbol is poorer than that shown by the double-circle symbol because of a greater shift, the print quality shown by the single-circle symbol can be judged as good. Each triangle symbol denotes a state in which a dot formed on the recording target medium is shaped like a snowman; still it is formed as a single dot. Though the shift between the landing position of the main droplet Dm and the landing position of the satellite droplet Ds in the dot formation result shown by the triangle symbol is greater than the shift therebetween in the dot formation result shown by the single-circle symbol, it can be judged as fair and acceptable (i.e., OK). Each x-indication symbol denotes a state in which the landing position of the main droplet Dm and the landing position of the satellite droplet Ds are completely away from each other, which results in the formation of two dots. That is, in this state, the two dots do not overlap at all. These separated two dots adversely affect the quality of a print image. Thus, it is judged as poor (i.e., NG).

In this experiment, ink that has viscosity of five millipascal seconds under normal temperature (e.g., twenty-five degrees Celsius) was used. The distance from the nozzles 27 of the recording head 2 to the printing surface of the recording target medium (e.g., recording paper 6) was set at 1.2 mm. The speed of the movement of the carriage 4 (i.e., the speed of the movement of the recording head 2) was set at 25 m/min. That is, normal conditions that are expected when an ordinary printer carries out printing were set as the experimental conditions for the results shown in the drawing.

Among the examples 1 to 13 of the present embodiment, all of the foregoing mathematical conditions (A) to (G) are met for the examples 1 to 6. Therefore, the print results for the present examples 1 to 6 are shown as double circles, which indicate excellent dot formation quality. Since all of the mathematical conditions (A) to (G) are met, it is possible to ensure that the main droplet Dm and the satellite droplet Ds move at ideal velocities in the air, respectively. In an apparatus that ejects liquid such as ink while moving the recording head 2 and the recording paper 6, which is an example of a recording target medium, relative to each other as done by the printer 1, the ideal in-the-air movement velocities make it possible to suppress a relative shift between a position at which the main droplet Dm lands on the recording target medium and a position at which the satellite droplet Ds lands on the recording target medium. Thus, the quality of a print image is excellent.

Each of the present examples 7 and 8 shows a case where the conditions (A) to (F) are met but the condition (G) is not met. Specifically, in the present example 7, the ratio of the time T', which is time from the start of the contraction portion p3 to the start of the re-contraction portion p7, to the vibration frequency Tc is set at 0.05. This value is smaller than the lower limit specified in the condition (G), that is, 0.1. Accordingly, the present example 7 shows a case where the re-contraction of the pressure chamber 25, which is driven by the re-contraction portion p7, is performed earlier in timing in comparison with the ideal condition. In the present example 8, the ratio of the time T' to the vibration frequency Tc is set at 0.8, which is larger than the upper limit specified in the condition (G), that is, 0.7. Accordingly, the present example 8 shows a case where the re-contraction of the pressure chamber 25, which is driven by the re-contraction portion p7, is performed later in timing in comparison with the ideal condition. The print results for the present examples 7 and 8 are shown as single circles, which indicate good dot formation quality. Each of the present examples 9 and 10 shows a case where the conditions (A) to (E) and the condition (G) are met but the condition (F) is not met. Specifically, in the present example 9, the ratio of the time width Wh2 of the contraction hold portion p4 to the vibration frequency Tc is set at 0.02. This value is smaller than the lower limit specified in the condition (F), that is, 0.03. Accordingly, the present example 9 shows a case where the time during which the capacity of the pressure chamber 25 is kept at the intermediate contraction capacity as driven by the contraction hold portion p4 is shorter in comparison with the ideal condition. In such a case, the movement of the satellite droplet Ds in the air is sometimes not stable. In the present example 10, the ratio of the time width Wh2 of the contraction hold portion p4 to the vibration frequency Tc is set at 0.3, which is larger than the upper limit specified in the condition (F), that is, 0.2. Accordingly, the present example 10 shows a case where the time during which the capacity of the pressure chamber 25 is kept at the intermediate contraction capacity as driven by the contraction hold portion p4 is longer in comparison with the ideal condition. The print results for the present examples 9 and 10 are also shown as single circles, which indicate good dot formation quality.

The present example 11 shows a case where the conditions (A) to (D) and the conditions (F) and (G) are met but the condition (E) is not met. Specifically, in the present example 11, the ratio of the time width Wd2 of the re-contraction portion p7 to the vibration frequency Tc is set at 0.6, which is larger than the upper limit specified in the condition (E), that is, 0.5. In such a case, the velocity of the movement of the satellite droplet Ds in the air is sometimes not high enough. For this reason, there is a possibility that a position at which the main droplet Dm lands on a recording target medium and a position at which the satellite droplet Ds lands on the recording target medium are shifted from each other to some degree. The print result for the present example 11 is shown as a triangle, which indicates fair and acceptable. The present example 12 shows a case where the conditions (A) to (C) and the conditions (E) to (G) are met but the condition (D) is not met. Specifically, in the present example 12, the ratio of the time width Wc2 of the re-expansion portion p5 to the vibration frequency Tc is set at 0.6, which is larger than the upper limit specified in the condition (D), that is, 0.5. The print result for the present example 12 is also shown as a triangle, which indicates fair and acceptable. The present example 13 shows a case where the conditions (A) and (B) and the conditions (D) to (G) are met but the condition (C) is not met. Specifically, in the present example 13, the ratio of the time width Wd1 of the contraction portion p3 to the vibration frequency Tc is set at 0.05, which is smaller than the lower limit specified in the condition (C), that is, 0.1. In such a case, the velocity of the movement of the main droplet Dm in the air is higher than the ideal velocity. For this reason, there is a possibility that a position at which the main droplet Dm lands on a recording target medium and a position at which the satellite droplet Ds lands on the recording target medium are shifted from each other to some degree. The print result for the present example 13 is shown as a triangle, which indicates fair and acceptable.

Each of the comparative examples 1 and 2 shows a case where the condition (A) and the conditions (C) to (G) are met but the condition (B), which is one of the indispensable conditions, is not met. Specifically, in the comparative example 1, the ratio of the amount of change in electrical potential V4 of the re-contraction portion p7 to the amount of change in electrical potential V2 of the contraction portion p3 is set at 0.1. This value is smaller than the lower limit specified in the condition (B), that is, 0.2. Accordingly, the comparative example 1 shows a case where the volume of the re-contraction of the pressure chamber 25, which is driven by the re-contraction portion p7, relative to the volume of the contraction of the pressure chamber 25, which is driven by the contraction portion p3, is smaller in comparison with the ideal condition. In such a case, the amount of pushing the tail part of an ink column due to the re-contraction of the pressure chamber 25 will be insufficient. For this reason, the distance between the main droplet Dm and the satellite droplet Ds in the air will be comparatively large. Thus, there is a risk that a relative shift between a position at which the main droplet Dm lands on a recording target medium and a position at which the satellite droplet Ds lands on the recording target medium will be large. In the comparative example 2, the ratio of the amount of change in electrical potential V4 of the re-contraction portion p7 to the amount of change in electrical potential V2 of the contraction portion p3 is set at 1.1. This value is larger than 1.0, which corresponds to the upper limit V2 specified in the condition (B). Accordingly, the comparative example 2 shows a case where the volume of the re-contraction of the pressure chamber 25, which is driven by the re-contraction portion p7, relative to the volume of the contraction of the pressure chamber 25, which is driven by the contraction portion p3, is larger in comparison with the ideal condition. In such a case, the amount of pushing the tail part of an ink column due to the re-contraction of the pressure chamber 25 will be larger than necessary. For this reason, for example, the pushed-out direction of the satellite droplet Ds in the air will not be straightforward. Thus, there is a risk that a relative shift between a position at which the main droplet Dm lands on a recording target medium and a position at which the satellite droplet Ds lands on the recording target medium will be large. The print result for each of the comparative examples 1 and 2 is shown as a cross, which indicates poor, and thus not acceptable.

The comparative example 3 shows a case where the conditions (B) to (G) are met but the condition (A), which is the other of the indispensable conditions, is not met. Specifically, in the comparative example 3, the ratio of the amount of change in electrical potential V3 of the re-expansion portion p5 to the amount of change in electrical potential V2 of the contraction portion p3 is set at 0.5. This value is larger than the upper limit specified in the condition (A), that is, 0.4. Accordingly, the comparative example 3 shows a case where the volume of the re-expansion of the pressure chamber 25, which is driven by the re-expansion portion p5, relative to the volume of the contraction of the pressure chamber 25, which is driven by the contraction portion p3, is larger in comparison with the ideal condition. In such a case, the amount of sucking a meniscus due to the re-expansion of the pressure chamber 25 will be larger than necessary. For this reason, for example, the ink column will be released from the meniscus at an earlier point in time. Alternatively, or in addition thereto, the amount (i.e., weight and volume) of the main droplet Dm will be insufficient. Since dot formation quality is poor, it is likely that the quality of a print image will be adversely affected. The print result for the comparative example 3 is also shown as a cross, which indicates poor, and thus not acceptable.

As explained in detail above, since the amount of change in electrical potential V2 of the contraction portion p3, the amount of change in electrical potential V3 of the re-expansion portion p5, and the amount of change in electrical potential V4 of the re-contraction portion p7 in the discharging pulse DP are set at values that satisfy the mathematical conditions (A) and (B), it is possible to suppress a relative shift between a position at which the main droplet Dm lands on a liquid ejection target medium and a position at which the satellite droplet Ds lands on the liquid ejection target medium. Specifically, after a decrease in the capacity of the pressure chamber 25 from the expansion capacity to the intermediate contraction capacity, which corresponds to the amount of change in electrical potential V2 of the contraction portion p3, the re-expansion portion p5 is applied to the piezoelectric vibration element 17 to increase the capacity of the pressure chamber 25 from the intermediate contraction capacity to the re-expansion capacity. As a result, the velocity of the movement of the head part of an ink column, which will form into the main droplet Dm when released, is reduced. Thereafter, the re-contraction portion p7 is applied to the piezoelectric vibration element 17 to decrease the capacity of the pressure chamber 25 from the re-expansion capacity to the re-contraction capacity. As a result, a meniscus is pushed rapidly in the direction of ejection. Thus, the tail part of the ink column is pushed out in an accelerated manner. Therefore, the velocity of the movement of the satellite droplet Ds in the air is higher than the velocity of the movement of the main droplet Dm in the air, which makes it possible to suppress a relative shift between a position at which the main droplet Dm lands on a liquid ejection target medium and a position at which the satellite droplet Ds lands on the liquid ejection target medium. Thus, degradation in the quality of a print image that is attributable to the shift between the landing position of the main droplet Dm and the landing position of the satellite droplet Ds does not occur. Even in a case where the discharging pulse DP does not have the re-expansion portion p5, and thus the capacity of the pressure chamber 25 is kept at the intermediate contraction capacity until the re-contraction of the pressure chamber 25 by the re-contraction portion p7 starts (V3/V2=0), at least the velocity of the movement of the satellite droplet Ds in the air is made higher, which contributes to suppression in the shift between the landing position of the main droplet Dm and the landing position of the satellite droplet Ds.

Besides the indispensable conditions (A) and (B), the parameters of the discharging pulse DP satisfy the conditions (C) to (F). Therefore, ink is ejected under optimal conditions. Thus, it is possible to suppress the relative shift between the landing position of the main droplet Dm and the landing position of the satellite droplet Ds on a liquid ejection target medium. Moreover, the time T', which is time from the start of the contraction portion p3 to the start of the re-contraction portion p7, satisfies the condition (G). Therefore, it is possible to start the re-contraction of the pressure chamber 25 by applying the re-contraction portion p7 to the piezoelectric vibration element 17 at an optimum point in time with due consideration given to the natural frequency Tc of vibration of ink retained in the pressure chamber 25 that occurs after contraction of the pressure chamber 25 caused by the application of the contraction portion p3 thereto. By this means, it is possible to prevent the velocity of the satellite droplet Ds from being higher than necessary or lower, thereby achieving the stable movement of the satellite droplet Ds in the air.

The scope of the invention is not limited to the specific embodiment described above. The invention may be modified in various ways.

The waveform of the discharging pulse DP is not limited to the example shown in the foregoing embodiment of the invention. It may be modified as long as its voltage waveform includes the following waveform portions: a first waveform portion in which a voltage level changes in a first direction to cause a change in capacity of a pressure chamber, a second waveform portion in which the voltage level changes in a second direction, which is opposite to the first direction, from an end voltage level of the first waveform portion to cause a change in the capacity of the pressure chamber, a third waveform portion in which the voltage level is kept at an end voltage level of the second waveform portion for a predetermined length of time to keep the capacity of the pressure chamber, or the voltage level changes in the first direction from the end voltage level of the second waveform portion to cause a change in the capacity of the pressure chamber, and a fourth waveform portion in which the voltage level changes in the second direction from an end voltage level of the third waveform portion to cause a change in the capacity of the pressure chamber.

In the foregoing embodiment of the invention, a so-called longitudinal-vibration-mode piezoelectric vibrator 17 is explained as an example of a pressure generator. However, the scope of the invention is not limited thereto. For example, a so-called deflection-vibration-mode piezoelectric element may be used as the pressure generator. In such a modified configuration, the direction of a change in the voltage level (i.e., potential) of the discharging pulse DP is reversed. That is, the waveform of the discharging pulse DP is turned upside down.

The invention can be applied to various types of liquid ejecting apparatuses that are capable of performing liquid-ejecting control by means of an ejection pulse. For example, the liquid ejecting apparatus may be embodied as various types of ink-jet recording apparatuses including but not limited to a plotter, a facsimile machine, and a copying machine as well as a printer explained herein. The uses/applications of the invention are not limited to recording apparatuses. For example, the liquid ejecting apparatus may be embodied as display manufacturing equipment, electrode manufacturing equipment, chip manufacturing equipment, and so forth. Display manufacturing equipment ejects a solution of red (R), green (G), and blue (B) colorants dissolved in a solvent from a color material ejection head. Electrode manufacturing equipment ejects an electrode material in the form of a liquid from an electrode material ejection head. Chip manufacturing equipment ejects a solution of a living organic material from a living organic material ejection head.

What is claimed is:

1. A method for controlling a liquid ejecting apparatus that includes a liquid ejecting head, a driving signal generating section, and a moving section, the liquid ejecting head including a nozzle from which liquid is ejected, a pressure chamber that is in communication with the nozzle, and a pressure generator that causes pressure fluctuation in the liquid retained in the pressure chamber, the liquid ejecting head being capable of ejecting the liquid from the nozzle as a result of operation of the pressure generator, the driving signal generating section generating a driving signal that contains an ejection pulse for driving the pressure generator to eject the liquid from the nozzle, the moving section moving the liquid ejecting head and a liquid ejection target medium relative to each other, the liquid ejection target medium being a target on which the ejected liquid lands, the method comprising:

moving the liquid ejecting head and the liquid ejection target medium relative to each other; and ejecting the liquid from the nozzle of the liquid ejecting head while performing the relative movement operation so as to cause the liquid to land on the liquid ejection target medium, wherein the ejection pulse is a voltage waveform that includes a first waveform portion in which a voltage level changes in a first direction to cause a change in capacity of the pressure chamber, a second waveform portion in which the voltage level changes in a second direction, which is opposite to the first direction, from an end voltage level of the first waveform portion to cause a change in the capacity of the pressure chamber, a third waveform portion in which the voltage level is kept at an end voltage level of the second waveform portion for a predetermined length of time to keep the capacity of the pressure chamber, or the voltage level changes in the first direction from the end voltage level of the second waveform portion to cause a change in the capacity of the pressure chamber, and a fourth waveform portion in which the voltage level changes in the second direction from an end voltage level of the third waveform portion to cause a change in the capacity of the pressure chamber, and amount of change in the voltage level of the second waveform portion, which is denoted as V2, amount of change in the voltage level of the third waveform portion, which is denoted as V3, and amount of change in the voltage level of the fourth waveform portion, which is denoted as V4, satisfy the following conditions (A) and (B);

$$0 \leq V3 \leq 0.4 \times V2 \quad (A)$$

$$0.2 \times V2 \leq V4 \leq V2 \quad (B)$$

wherein, when natural frequency of vibration that occurs in the liquid retained in the pressure chamber is demoted as Tc, time width of the second waveform portion, which is denoted as Wd1, time width of the third waveform portion, which is denoted as Wc2, and time width of the fourth waveform portion, which is denoted as Wd2, satisfy the following conditions (C), (D), and (E), respectively;

$$0.1 \times Tc \leq Wd1 \quad (C)$$

$$Wc2 \leq 0.5 \times Tc \quad (D)$$

$$Wd2 \leq 0.5 \times Tc \quad (E).$$

2. A method for controlling a liquid ejecting apparatus that includes a liquid ejecting head according to claim 1, wherein, the ejection pulse further includes an intermediate hold portion between the second waveform portion and the third waveform portion; the voltage level is kept at the end voltage level of the second waveform portion for a predetermined length of time; and time width of the intermediate hold portion, which is denoted as Wh2, satisfies the following condition (F);

$$0.03 \times Tc \leq Wh2 \leq 0.2 \times Tc \quad (F).$$

3. A method for controlling a liquid ejecting apparatus that includes a liquid ejecting head according to claim 1, wherein time T', which is time from start of the second waveform portion to start of the fourth waveform portion, satisfies the following condition (G);

$$0.1 \times Tc \leq T' \leq 0.7 \times Tc \quad (G).$$

* * * * *